US009403133B2

(12) United States Patent
Baron

(10) Patent No.: US 9,403,133 B2
(45) Date of Patent: Aug. 2, 2016

(54) STATIC MIXER ASSEMBLY

(75) Inventor: John Michael Baron, Macclesfield (GB)

(73) Assignee: Statiflo International Limited, Cheshire (GB)

( * ) Notice: Subject to any disclaimer, the term of this patent is extended or adjusted under 35 U.S.C. 154(b) by 82 days.

(21) Appl. No.: 13/978,420

(22) PCT Filed: Jan. 6, 2012

(86) PCT No.: PCT/GB2012/000007
§ 371 (c)(1),
(2), (4) Date: Jul. 5, 2013

(87) PCT Pub. No.: WO2012/095623
PCT Pub. Date: Jul. 19, 2012

(65) Prior Publication Data

US 2013/0286769 A1 Oct. 31, 2013

(30) Foreign Application Priority Data

Jan. 15, 2011 (GB) ..... 1100673.1

(51) Int. Cl.
*B01F 5/06* (2006.01)

(52) U.S. Cl.
CPC ..... *B01F 5/0602* (2013.01); *B01F 5/0618* (2013.01); *B01F 2005/0625* (2013.01); *B01F 2005/0636* (2013.01)

(58) Field of Classification Search
CPC .... B01F 5/0682; B01F 5/0688; B01F 5/0602; B01F 5/0618
USPC ..... 366/336; 336/336, 337, 338, 339, 340, 336/172.1, 172.2, 174.1, 175.1, 175.2
See application file for complete search history.

(56) References Cited

U.S. PATENT DOCUMENTS 4,643,584 A * 2/1987 Allocca ..... B01F 5/0617 165/135

(Continued)

FOREIGN PATENT DOCUMENTS

CH 696755 A5 11/2007
DE 19755905 C1 5/1999

(Continued)

OTHER PUBLICATIONS

Westfall Manufacturing Company, 2850 Inline Static Mixers, site accessed Jul. 8, 2013, http://www.westfallmfg.com/2850_inline_static_mixer.

(Continued)

*Primary Examiner* — Tony G Soohoo
*Assistant Examiner* — Anshu Bhatia
(74) *Attorney, Agent, or Firm* — Bracewell LLP; Constance Gall Rhebergen

(57) ABSTRACT

Apparatus and methods are described for use in mixing of fluids or mixing ingredients into fluids by means of a static mixer assembly (i.e. without requiring moving mechanical parts, where fluid flow is used to achieve mixing). The static mixer assembly is a cylindrical tube with three pairs of fins extending inward from the inner wall of the tube. The central fins form a prow pointing upstream, with two pairs of flanking fins arranged to prevent unhindered fluid flow parallel to the central axis of the tube a peripheral region, while allowing unobstructed flow in a central region and extending to a peripheral region near the inner wall opposite the prow. The fins force fluid outwards along the inner walls from the prow towards the unobstructed peripheral region opposite the prow and additionally fluid spills over the inner edges of the fins into the central region. The resulting flow pattern provides excellent mixing with a low ratio of pressure drop to volumetric flow rate across the assembly. Ingredients inserted into the unobstructed peripheral region opposite the prow are rapidly homogenized into flowing fluid.

22 Claims, 5 Drawing Sheets

(56) References Cited

U.S. PATENT DOCUMENTS

| | | | | |
|---|---|---|---|---|
| 5,330,267 | A | 7/1994 | Tauscher | |
| 5,800,059 | A | 9/1998 | Cooke et al. | |
| 5,839,828 | A | 11/1998 | Glanville | |
| 5,967,658 | A | 10/1999 | Mohajer | |
| 6,604,850 | B1 * | 8/2003 | Schneider et al. | 366/175.2 |
| 7,104,251 | B2 * | 9/2006 | Kim | 123/306 |
| 7,316,503 | B2 | 1/2008 | Mathys et al. | |
| 2003/0072214 | A1 | 4/2003 | Fleischli et al. | |
| 2010/0147242 | A1 * | 6/2010 | Yang | 123/184.21 |
| 2010/0265792 | A1 | 10/2010 | Krumboeck | |

FOREIGN PATENT DOCUMENTS

| | | | |
|---|---|---|---|
| EP | 1302236 | A1 | 4/2003 |
| EP | 1493485 | A1 | 1/2005 |
| EP | 2098697 | A1 | 9/2008 |
| EP | 1982756 | A1 | 10/2008 |
| SU | 1650227 | A1 | 5/1991 |
| WO | 98/05872 | A1 | 2/1998 |

OTHER PUBLICATIONS

International Search Report for PCT/GB2012/000007 dated Apr. 17, 2012 (2 pages).

UKIPO Search Report for Application No. GB1100673.1 dated May 23, 2011 (4 pages).

* cited by examiner

STATIC MIXER ASSEMBLY

FIELD

The present invention relates to methods and apparatus for mixing a fluid or fluids flowing through a pipe, or for mixing one or more ingredients into such a fluid, by means of a static mixer assembly located in, or forming part of the pipe. The static mixer assembly of the invention is particularly useful for homogenisation of low viscosity fluids such as gases or low viscosity liquids and may be used for homogenisation of solutions or dispersions or for providing substantially uniform mixing of a component or ingredient dosed into the fluid flowing through the pipe at, or upstream of, the static mixer assembly of the invention.

BACKGROUND

Static mixer assemblies are known in the art. Many approaches have been used in the design of static mixer assemblies depending upon the desired degree of mixing required and the pressure drop or loss which may be tolerated across the static mixing arrangement for a required volumetric flow rate through the static mixer assembly. Generally, the greater the volumetric flow rate through a static mixer assembly, the greater will be the pressure drop required across the assembly in order to achieve the desired flow rate.

A high degree of mixing is desirable in combination with a low pressure drop across the static mixer assembly and a high volumetric flow rate. Typically, dimensionless parameters such as System loss coefficient or Darcy friction factor are used to assess the head-loss or pressure drop for any particular volumetric flow rate. It is desirable that these values be as low as possible whilst the static mixer assembly provides homogeneous mixing. By homogeneous mixing it is meant, for instance, that the concentration of one or more ingredients introduced at one or more locations upstream or downstream of the static mixer assembly is uniformly distributed both axially and radially at a location downstream of the static mixer assembly. So, for instance, if the static mixer achieves homogeneous mixing at a distance L downstream of the static mixer assembly, then any element of the cross sectional area at L will exhibit substantially the same concentration of the ingredient, say within +/−1% of the mean concentration of the ingredient, and this will also be the case for any cross section downstream of L. In the industry, time averaged values for coefficient of variation of ingredient concentration are used as a measure of mixing homogeneity. A value of 0.05 or less is considered to indicate good mixing. Details of the measurement of this parameter are set out hereinafter.

It is also desirable for simple construction materials and techniques to be utilised in the manufacture of the static mixer assembly whereby manufacturing costs can be kept low. Ideally, the mixing required would be achieved with few, simple, mixing elements making up the static mixer assembly within a pipe through which the fluid flows. By definition, the mixing elements are rigidly fixed within the pipe (or within an insert to be fitted into a pipe), this being a fundamental feature defining a static mixer assembly (i.e. no moving mechanical parts are required, mixing is induced by the flow of a fluid through the static mixer assembly).

The mixing elements of prior art static mixer assemblies are typically obstacles around which the fluid, flowing along a pipe, is constrained to flow. As fluid passes around the obstacles, vortices may be initiated at the edges of the obstacles and these will detach from the obstacles at regular time intervals. As the vortices proceed along the pipe downstream of the obstacles, additive to be mixed into the fluid may be taken up in the vortices and so redistributed throughout the fluid by the vortex flow. However, the periodicity of detachment of vortices may lead to axial inhomogeneity in the distribution of the mixed-in additive. A static mixer assembly is disclosed in U.S. Pat. No. 5,839,828, which discloses a static mixer arrangement comprising a circumferential flange extending inwards from an internal wall of a pipe, the flange having at least a pair of opposed flaps extending inwards therefrom and inclined in the direction of fluid flow.

U.S. Pat. No. 7,316,503 discloses a static mixer for low viscosity fluid containing inbuilt devices arranged in a pipe conducting the fluid. A plurality of flow obstacles are disposed to define constrictions therebetween for flow of a viscous fluid therethrough and to impart a flow of a first order in the flow of viscous fluid passing through the constrictions, including vortex spheres which periodically separate off the obstacles, said to produce radial and axial inhomogeneities in the form of axial concentration differences in the flow of viscous fluid.

Each primary flow obstacle of this prior art has a geometrically modified area for at least one surface and an edge thereof to induce local flows of a second order in the flow of viscous fluid passing thereover whereby the local flow of second order is superimposed on the flow of first order to compensate for radial and axial inhomogeneities in the viscous fluid produced by the flow of first order. The flow obstacles disclosed in U.S. Pat. No. 7,316,503 are complex in shape and may require multiple manufacturing steps for their formation.

Despite the existence of various known static mixer arrangements, there is a developing need for mixers of this type with better mixing efficiency and homogeneity of mixed fluid in combination with reduced static mixer assembly length, to facilitate the incorporation of the static mixer assembly into a plant, and with reduced pressure drop across the static mixer assembly for a desired volumetric flow rate, to reduce flow resistance and pumping requirements for the plant into which the static mixer is to be incorporated.

SUMMARY OF THE INVENTION

It is one object of the present invention, amongst others, to substantially address one or more of the problems of the prior art. It is an object of particular embodiments of the present invention to provide an improved apparatus, for providing homogeneous mixing of a fluid flowing therethrough, with a low ratio of pressure drop to volumetric flow rate across the apparatus.

A first aspect of the invention provides a static mixer assembly comprising a tube having a central axis with three pairs of fins extending inwards from an inner wall of the tube, symmetrically arranged about a plane of symmetry passing through the central axis, wherein the first central fins are arranged to form a prow along the plane of symmetry and pointing upstream, with second and third pairs of fins flanking the first fins and arranged to mutually overlap whereby unhindered fluid flow downstream parallel to the central axis of the tube is prevented over a hindered peripheral, annular region of the tube, whilst allowing unobstructed flow in an unobstructed flow region of the tube, the unobstructed flow region comprising a central region of the tube around the central axis and extending to a peripheral region of the tube opposite the prow.

A second aspect of the invention provides a fluid processing apparatus comprising a pipe arranged for flow of a fluid therethrough and a static mixer assembly according to the first aspect of the invention, operably disposed therein.

A third aspect of the invention provides a method of mixing an ingredient into a fluid, the method comprising flowing the fluid through a static mixer assembly according to the first aspect of the invention and inserting the ingredient to be mixed into the fluid at a location upstream of the static mixer assembly.

DETAILED DESCRIPTION OF THE INVENTION

Throughout this specification, the term "comprising" or "comprises" means including the component(s) specified but not to the exclusion of the presence of others. The term "consisting essentially of" or "consists essentially of" means including the components specified but excluding other components except for materials present as impurities, unavoidable materials present as a result of processes used to provide the components, and components added for a purpose other than achieving the technical effect of the invention. Whenever appropriate, the use of the term "comprises" or "comprising" may also be taken to include the meaning "consists essentially of" or "consisting essentially of".

The static mixer assembly of the invention is intended and suitable for use under conditions of turbulent flow, for instance with a Reynolds number of 2000 or more, such as 4000 or more. (Reynolds number $Re=\rho UD/\mu$ where $\rho$ is density, U is velocity of bulk flow, D is the channel diameter and $\mu$ is the fluid's dynamic viscosity)

The first aspect of the invention provides a static mixer assembly comprising a tube having a central axis with three pairs of fins extending inward from an inner wall of the tube, symmetrically arranged about a plane of symmetry passing through the central axis.

The first, or central, fins are arranged to form a prow along the plane of symmetry passing through the central axis of the tube, and the prow or chevron shape is arranged to be pointing upstream relative to the intended direction of flow of fluid through the static mixer.

Flow of fluid entering the static mixer assembly will be will be substantially linear turbulent flow oriented with the bulk flow direction parallel to the central axis of the tube.

The second and third pairs of fins are arranged to be flanking the first fins and arranged to mutually overlap with each other and with the central fins whereby unhindered fluid flow downstream parallel to the central axis of the tube is prevented over a hindered peripheral, annular region of the tube.

In other words, viewed from a vantage point along the central axis and looking at the static mixer assembly in a downstream direction, the leading edges of the second fins are in front of the trailing edges of the first fins and the leading edges of the third fins are in front of the trailing edged of the second fins, so that fluid is forced to flow in off-axis channels formed between the first and second fins and the second and third fins in a hindered, peripheral, annular region of the tube.

Unobstructed flow is allowed in an unobstructed flow region of the tube, the unobstructed flow region comprising a central region of the tube around the central axis. This extends to a peripheral region of the tube opposite the prow, for instance at the inner wall for a closed tube. The fins will not be present in this unobstructed flow region and so the fluid may here pass unhindered in a direction parallel to the central axis.

Without wishing to be bound by any theory, it is thought that the fins force fluid to flow outwards along the periphery of the inner walls from the central prow or chevron of the first fins towards the unobstructed peripheral region opposite the central prow. Additionally fluid may spill out of the channels, over the inner edges of the fins and into the central, unobstructed flow region of the tube.

It is thought that the combinations of peripheral flow, spilt flow and axial flow in the unobstructed flow region of the tube provide excellent mixing characteristics for the static mixer assembly of the invention without leading to high pressure drops across the assembly for acceptable volumetric flow rates.

The static mixer assembly of the invention may be used for homogenisation of fluid or of the characteristics of a fluid flowing through it. For instance, a flow of fluid having a non-uniform temperature distribution upstream of the static mixer assembly of the invention may have its temperature homogenised by passage through the static mixer assembly.

The invention is also useful for homogeneous incorporation of ingredients into a fluid flow. Ingredients inserted into the unobstructed peripheral region opposite the prow are rapidly homogenised into flowing fluid. By "rapidly" it is meant that homogeneous mixing is achieved at a relatively short distance downstream of the static mixer assembly. In the prior art, injection methods may be employed to introduce a minor ingredient as a "side stream" into the major bulk flow ("main stream") of flowing material. Typically, such methods require injector pipes, to bring the side stream into the body of the main stream, and baffle plates to provide adequate mixing. Such additional components, necessary for mixing homogeneity, impede the main stream and so increase the pressure drop across the mixer. Such components may also be prone to breakage and may suffer from accumulation of solids or fibres deposited from the flow. The arrangement of the present invention, with its angled, internal fins, diverts the main stream into the side stream at the walls of the mixer in the unobstructed peripheral region, thus removing the need for injector pipes, or baffles that would lead to excessive pressure drop, extending into the main stream. This reduces risk of breakage and reduces likelihood of deposition onto internal surfaces of the mixer.

The first aspect of the invention will now be set out in more detail in relation to a static mixer in the form of a substantially cylindrical tube.

The inner cylindrical wall of the static mixer assembly may extend between upstream and downstream faces, each face substantially normal to a central axis of the tube and the plane of symmetry passing through the central axis and a diameter of the tube may define first and second long axes, each parallel to the central axis and located where the plane of symmetry meets the inner wall of the tube. The plane of symmetry and the central and long axes as referred to in this description are all virtual or hypothetical, and are merely used as references to aid in the description of the configuration and arrangement of the apparatus of the invention. No physical presence or manifestation of the presence of these features is required.

Any location within or on the cylindrical inner wall may be defined by cylindrical coordinates r,t,z, where t is the angle subtended at the central axis between the first long axis and the location, in a measurement plane, passing through the location and normal to the central axis, wherein r is the distance from the central axis to the location, measured in the measurement plane and wherein z is the distance, measured along the central axis, between the point where the upstream plane intersects the central axis and the point where the central axis intersects the measurement plane. This is shown schematically in FIG. 9. In FIG. 9, the upstream face 4 is shown as lying normal to the central axis 20 with the first long axis 21 also shown, passing through the intersection between the plane of symmetry 23 and the upstream face 4.

The co-ordinates for the point X shown in the Figure are defined as follows. The value of r is set by the radius r of the circular plane 30 with its circumference passing through the point X and lying normal to the central axis 20. The value of z is the distance between the intersection of the upstream face 4 and the intersection of the plane 30 and the central axis 20, measured along the central axis 20. The value of the angle t is measured between a line extending between the intersection of plane 30 and central axis 20 and the first long axis 21 lying normal to these axes and parallel to the plane 30, and a line on the circular plane 30 passing through the central axis 20 and the point X.

Hence, r=R at the inner cylindrical wall, z=Z at the downstream plane and T=0° and r=R at the first long axis and T=180° and r=R at the second long axis.

Each fin of the first, second and third pairs of fins may extend inwards from an attachment edge at the inner wall of the tube and each member of each pair of fins is positioned substantially symmetrically with respect to the other member of its respective pair on opposed sides of the plane of symmetry.

Each fin may have a leading edge extending inwards from the inner wall at an upstream location, and a trailing edge extending inwards from the inner wall at a downstream location. The attachment edge has a length connecting its respective fin to the inner wall between upstream and downstream locations and a deflection edge opposed to the attachment edge.

The upstream location of both first fins may be at, or near the upstream face, at r,t,z=R, 0, Zu1 with the leading edges of the first fins joined to form a prow extending inward from the upstream location of the first fins. The downstream locations of the first fins are positioned on opposite sides of the plane of symmetry at r,t,z=R, Td1,Zd1 and R,−Td1,Zd1.

The upstream locations of the second fins may be at or near the upstream face, on opposite sides of the plane of symmetry, at r,t,z=R,Tu2, Zu2 and R,−Tu1, Zu2 with the downstream locations of the second fins at r,t,z=R,Td2,Zd2 and r,t,z=R,−Td2,Zd2.

The upstream locations of the third fins may be at the upstream face, on opposite sides of the plane of symmetry, at r,t,z=R,Tu3,Zu3 and R,−Tu3,Zu3 with the downstream locations of the third fins at r,t,z=R,Td3,Zd3 and R,−Td3,Zd3.

Specifically, it may be that 0≤Zu1≤Zu2≤Zu3, meaning that the upstream locations of the first, second and third fins are all at the same axial position, or that the second fins leading edges are downstream of the first fins leading edges, and the third fins leading edges are level with or downstream of the second fins leading edges.

Suitably, Zd1>Zu1, Zd2>Zu2 and Zd3>Zu3, and Tu2<Td2, Tu3<Td3.

This means that the downstream edges for each fin are downstream of the upstream edges of the respective fin, and the fins are angled to form a central chevron with flanking outer fins. Thus the fins are arranged to form channels between the adjacent first and second fins and second and third fins, the channels arranged to direct the flow of liquid peripherally outwards along the inner wall from the central prow formed between the first fins, diverting the fluid bulk flow from its original direction parallel to the central axis. Also, with Tu2<Td1, Tu3<Td2, no gaps are left between the fins that would allow unhindered passage of fluid flowing parallel to the central axis to pass between the downstream edge of the first fin and the upstream edge of the second fin, or the downstream edge of the second fin and the upstream edge of the third fin.

Furthermore, suitably Zd1, Zd2 and Zd3 are all less than or equal to Z. This means that the downstream locations of the fins do not project beyond the downstream face of the static mixer assembly.

The length of the attachment edge for each fin, measured along a straight line between the upstream and downstream locations for the respective fin, is suitably from 0.2R to 3R, preferably from 0.3R to 2.5 R.

The value of r for any point along each deflection edge of each fin is suitably 0.4 R or more, whereby a central region of the pipe extending at least 0.4R outwards from the central axis provides an unhindered fluid flow path. This minimum r value for the deflection edge of each fin may be 0.5 R or more, even 0.6 R or more. This defines a central region of the static mixer of the invention over which unobstructed flow of fluid parallel to the central axis is possible, as the fins do not project inwards from the cylindrical inner wall into this region.

The pairs of fins are suitably configured to provide a perimetral region of the pipe extending at least 0.2R inwards from the inner cylindrical wall axis between t=+90° and t=−90° over which an unhindered fluid flow path parallel to the central axis is prevented. This defines the hindered, peripheral, annular region of the tube.

For instance, the pairs of fins may be configured to provide a perimetral region of the pipe extending at least 0.2R inwards from the inner cylindrical wall axis between t=+160° and t=−160° over which an undeviated fluid flow path parallel to the central axis is prevented.

The pairs of fins may be configured to provided an unhindered peripheral flow path over at least a region defined by 170°≤t≤−170° and r≤R. This defines the part of the unobstructed flow region extending to a peripheral region of the tube at the inner cylindrical wall opposite the prow over which unobstructed flow of fluid parallel to the central axis is possible. This combines with the central region over which unobstructed flow of fluid parallel to the central axis is possible, to form the overall unobstructed flow region into which the fins do not project.

It may be that Zu1=Zu2=Zu3, whereby the upstream locations of the fins are level with each other (i.e. at the same axial location).

It may be that Zu1=Zu2=Zu3=0 whereby the upstream locations of the leading edges are all at the same axial location at the upstream face of the static mixer assembly.

Suitably, Zd3>Zd2>Zd1 so that the outermost, third fins extend further downstream than the intermediate second fins, which in turn extend further downstream than the first, central fins.

Suitably, Zd3 is from 0.3R to 1.5R in order to provide good mixing in combination with a reasonable ratio between pressure drop across the assembly and volumetric flow rate.

For instance, it may be that Zu1=0 and Zd3=Z, so that the upstream location of the first fins is at the upstream face of the static mixer assembly and the downstream location of the outermost fin is at the downstream face of the static mixer assembly. This provides the most economic use of materials for making up the mixer assembly.

The mixer assembly of the invention may be provided with suitable fastening means at the upstream and downstream faces whereby the static mixer assembly may be incorporated into a fluid processing apparatus. For instance, the assembly of the invention may be provided with external flanges at the upstream and downstream faces adapted to mate with pipe flanges of pipes in a fluid processing apparatus whereby the static mixer assembly may be fitted, for instance, between two sections of pipe, in order to incorporate it into a fluid processing apparatus.

It will be evident that the static mixer assembly of the invention may be incorporated into a fluid processing apparatus by any suitable means. For instance the outer diameter of an assembly according to the invention may be arranged to allow the static mixer assembly to slide into a pipe of a fluid processing apparatus where it can be subsequently fixed in place.

Tu3 is suitably 120° or less, for instance 90° or less. Td3 may be 170° or less, for instance 160° or less.

Typically, the angular difference between the upstream and downstream location for each fin is from 25° to 70°. Preferably, the fins on each side of the plane of symmetry lie substantially mutually parallel to each other whereby substantially uniform channels are formed between them to deviate the flow of fluid passing through the static mixer array.

Typically, the static mixer assembly of the invention will suitably have an internal diameter (2R) from 100 mm to 3 m. The ratio of the length Z of the static mixer assembly to the radius R may be selected in order to provide a mixer with a required downstream degree of mixing and corresponding pressure drop. The smaller the value of Z/R, the greater the pressure drop, but the better the speed of mixing (i.e. less downstream distance is required to achieve homogeneous mixing). Typically, Z/R may be from 0.1 to 3, for instance from 0.2 to 2, preferably from 0.25 to 1.5=, for instance 0.3 to 1.

Any suitable rigid constructional material may be used for the static mixer assembly of the invention, such as metal or rigid polymer, and mixtures of constructional materials may be used.

Suitably, each fin is a substantially flat plate. Each fin may be arranged substantially normal to the inner cylindrical wall and extend inwards towards the central axis.

To facilitate ease of construction of the static mixer assembly of the invention, each fin may be located in a respective straight slot in the inner cylindrical wall configured to accept a fin. For instance, a sawing or milling apparatus may be used to cut suitable slots in the cylindrical inner wall of the tube and the fins attached within these slots, for instance adhered or welded in place. This enables the static mixer assembly of the invention to be assembled easily from a section of tubing and a sheet of material merely be cutting and welding or adhering without the need for special moulding or bending steps to be taken.

The static mixer assembly of the invention may further include an ingredient insertion port. This will typically be operably connected to an ingredient delivery means such as a vessel and pump arranged to dose the ingredient into the fluid flow through the ingredient insertion port. Preferably, this ingredient insertion port may be located in the unobstructed fluid flow region, more preferably in the part of the unobstructed flow region extending to a peripheral region of the tube at the inner cylindrical wall opposite the prow. For instance, the ingredient injection port may suitably be located at position Rp,Tp,Zp wherein $0.8R \leq Rp \leq R$, $170° \leq Tp \leq -170°$ and $0 \leq Zp \leq Z$.

Each fin may suitably have a thickness of R/30 or less. Edges of the fins may be rounded or smoothed to remove angular edges.

The features set out hereinbefore in relation to the first aspect of the invention may also be applied to the second and third aspects of the invention set out hereinafter, where appropriate.

The second aspect of the invention provides a fluid processing apparatus comprising a pipe arranged for flow of a fluid therethrough and a static mixer assembly according to the first aspect of the invention, operably disposed therein.

The apparatus of the second aspect of the invention may further comprise an ingredient insertion port. This may be located in the manner set out above in relation to the static mixer assembly of the first aspect of the invention, or may be positioned to inject an ingredient, or one or more ingredients, into the fluid within the pipe at a location upstream or downstream of the static mixer assembly whereby homogeneous mixing of the ingredient(s) with said fluid is achievable downstream of the static mixer assembly.

The ingredient insertion port may be located upstream to deliver ingredient to enter into the static mixer assembly at a position Rp,Tp,Zp wherein $0.8R \leq Rp \leq R$, $170° \leq Tp \leq -170°$ and Z=0.

The third aspect of the invention provides method of mixing an ingredient into a fluid, the method comprising: flowing the fluid through a static mixer assembly according to the first aspect of the invention, and inserting the ingredient to be mixed into the fluid at a location upstream or downstream, preferably upstream of the static mixer assembly.

Preferably, the ingredient is inserted at a position in the fluid whereby ingredient is delivered into the unobstructed fluid flow region, more preferably into the part of the unobstructed flow region of the static mixer assembly, preferably into the part of the unobstructed flow region extending to the peripheral region of the tube at the inner cylindrical wall opposite the prow. For instance, the ingredient may be delivered whereby it enters into the static mixer assembly at a position Rp,Tp,Zp wherein $0.8R \leq Rp \leq R$, $170° \leq Tp \leq -170°$ and Z=0.

The term fluid encompasses any materials that are capable of flow, including gases, fluidised powders, liquids, pastes, dispersions, emulsions, liquid crystals and the like. The apparatus of the invention is particularly suitable for use with liquids of relatively low viscosity, for instance liquids having a viscosity of 100 mPa·s or less at a shear rate of 21 $sec^{-1}$, for instance from say 0.01 to 200 mPa·s. However, more viscous fluids may also be used with the apparatus. As explained hereinbefore, the static mixer assembly of the invention is intended for use with fluid flows such that the flow is turbulent (e.g. with Re having a value of 2000 or more, typically 4000 or more).

BRIEF DESCRIPTION OF THE DRAWINGS

Specific embodiments of the present invention will now be described, by way of example only, with reference to the accompanying drawings in which.

DETAILED DESCRIPTION OF THE DRAWINGS

Figure 9:
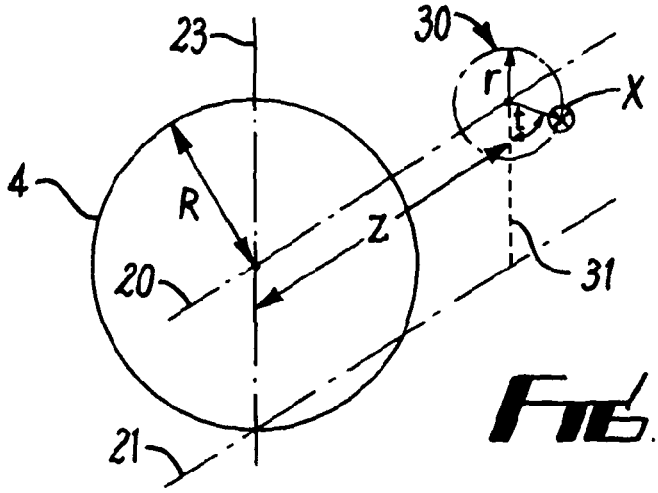
FIG. 9 shows a schematic view explaining how the cylindrical co-ordinates set out hereinbefore are measured for a point.

FIG. 9, a schematic diagram explaining how the polar co-ordinates used in this description are measured, has already been described in detail hereinbefore and this will not be repeated here. However, it may be helpful to refer to FIG. 9 in order to understand the meanings of the co-ordinates r,t,z referred to below.

Turning to the first embodiment of the invention as shown in FIGS. 1, 2, 3 and 4, the static mixer assembly 1 of the first embodiment has a tube 2 in the form of a cylinder extending between an upstream face 4 and a downstream face 5 with each face normal to the central axis 20 of the tube 2. The tube has a cylindrical inner wall holding three pairs of fins. The first pair of fins 6, 7 meet at a prow 8 which lies on the plane of symmetry 23. Fin 6 has an attachment edge 11 extending from the upstream location of fin 6 to its downstream location from which the trailing edge 9 of fin 6 extends inwards from the inner wall. The leading edge 8 and the trailing edge 9 extend outwards to the deflection edge 13 of fin 6. The corresponding first fin 7 is symmetrically disposed about the plane of symmetry 23 with respect to first fin 6. First fin 7 extends from its leading edge 8 to its trailing edge 10 between an attachment edge 12 and deflection edge 14. The leading edge 8 and trailing edge 10 meet the inner wall 3 at the upstream and downstream locations of first fin 7.

The second fins 15, 16 are attached to the inner wall 3 and positioned substantially parallel to the corresponding first fins 6, 7 on each side of the plane of symmetry 23. The upstream locations for the second fins 15, 16 are at the upstream face 4 with values for r, t, z of R, −20°, 0 for second fin 15 and R, +20°, 0 for second fin 16.

The third fins 17, 18 are disposed to lie substantially parallel to both the first and second fins on the respective sides of the plane of symmetry. The upstream location for the second fins 17, 18 are at R, −90°, 0 and R, 90°, 0, at the upstream face, for the third fin 17 and third fin 18 respectively.

Figure 3:
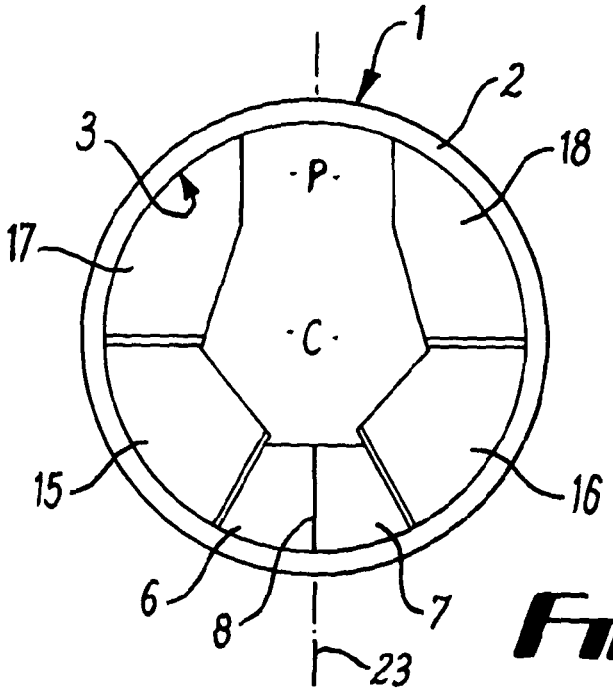
FIG. 3 shows a front plan view of the static mixer assembly of the first embodiment as viewed in the direction A shown in FIG. 2.
Figure 4:
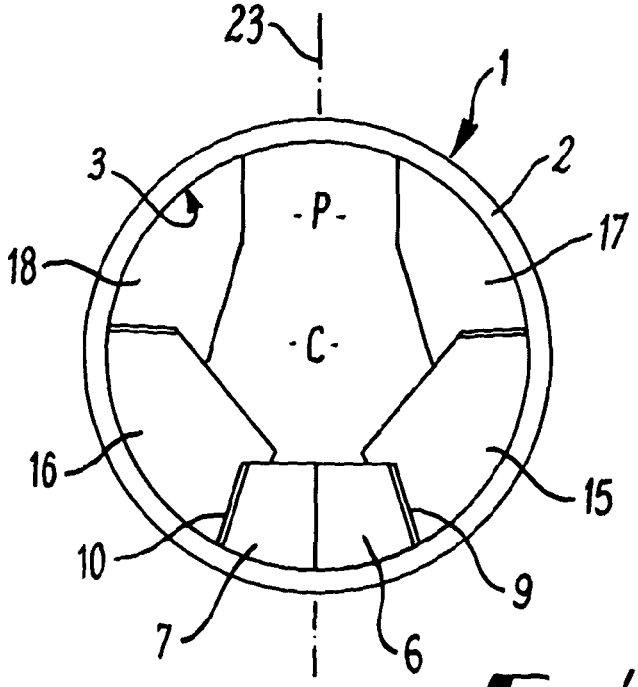
FIG. 4 shows a rear plan view of the first embodiment viewed from the direction directly opposite to direction A shown in FIG. 2.

As can be seen from FIGS. 3 and 4, the fins are arranged to overlap so that the upstream edges of third fins 17, 18 overlap the downstream edges of second fins 15, 16 and the upstream edges of second fins 15, 16 overlap the downstream edges of first fins 6, 7 respectively. As can be seen in FIGS. 3 and 4, this leads to a hindered peripheral annular region of the tube formed by the overlapping of fins, whilst allowing unobstructed flow in a central region of the tube C and a peripheral region of the tube P opposite the prow 8 formed where the first fins 6, 7 meet at the leading edge.

For the static mixer assembly according to the first embodiment of the invention as shown in FIGS. 1 to 4, the length of the tube Z measured along the central axis 20 is equal to the internal diameter of the tube 2 (2R)

Figure 1:
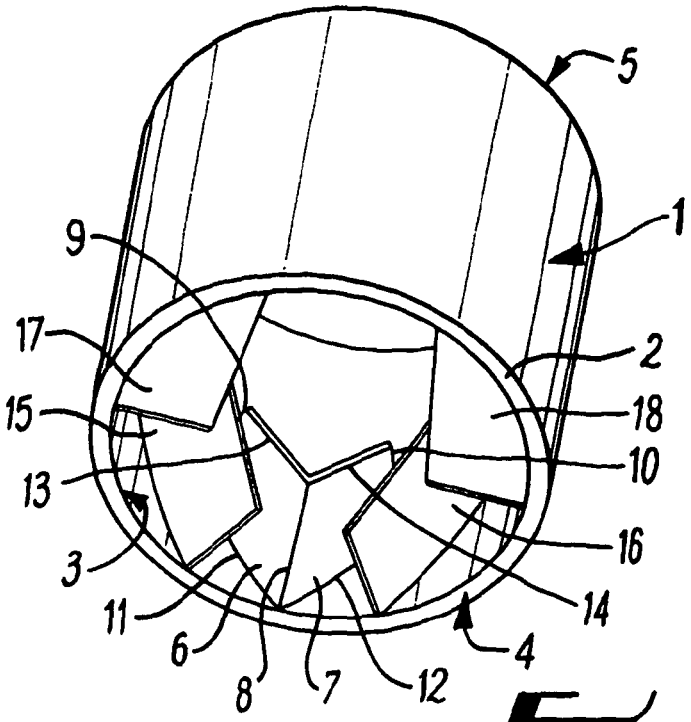
FIG. 1 shows a perspective view of a first embodiment of a static mixer assembly according to the first aspect of the invention.
Figure 2:
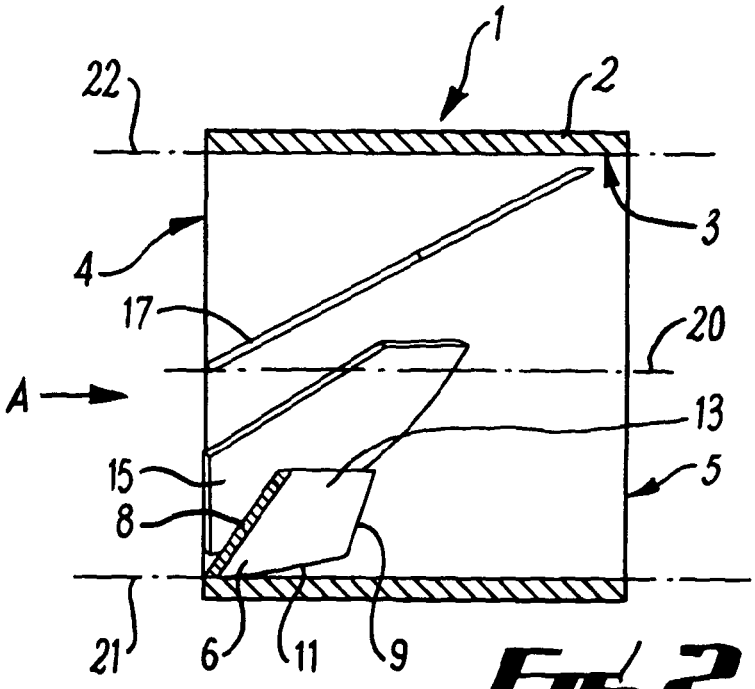
FIG. 2 shows a cross-sectional side view through the first embodiment with the plane of the cross-section corresponding to the plane of symmetry of the static mixer assembly 1.

FIG. 2 also shows the locations of the first long axis 21 and second long axis 22 used to define the cylindrical polar coordinates used in the description of the invention set out above. The angle used in the coordinates is measured between a line passing from the central axis 20 to the first long axis 21 and a line drawn normal to the central axis 20 and passing through the point whose coordinates is required.

Figure 5:
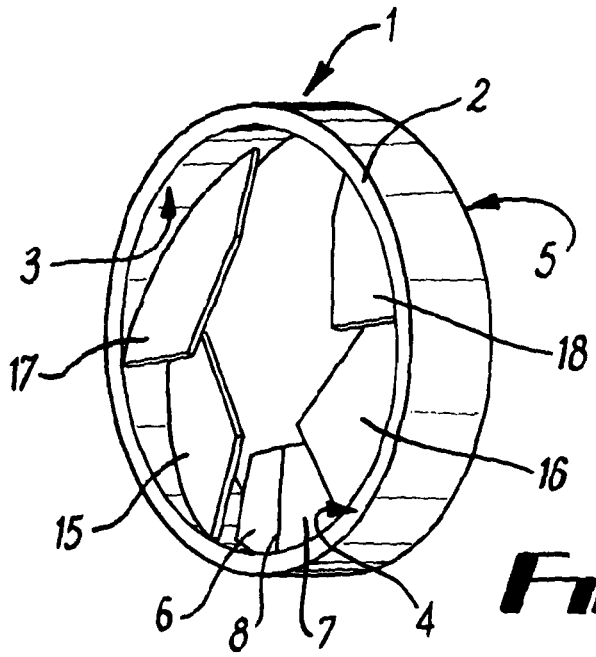
FIG. 5 shows a front perspective view of a second embodiment of a static mixer assembly according to the first aspect of the invention.
Figure 6:
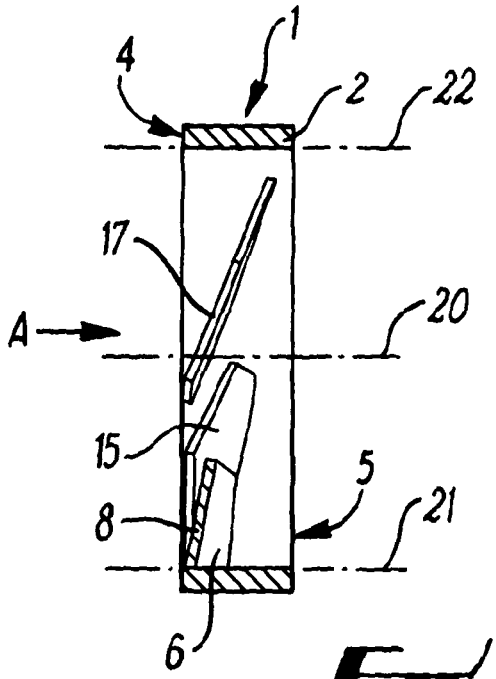
FIG. 6 shows a schematic side cross-sectional view through the second embodiment, with the cross-sectional plane lying on the plan of symmetry 23.
Figure 7:
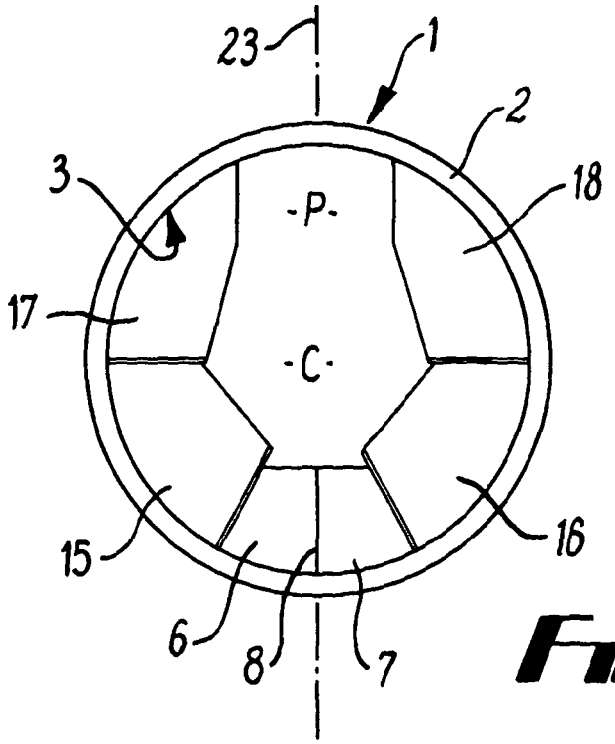
FIG. 7 shows a front plan view of the second embodiment as viewed in direction A shown in FIG. 6.
Figure 8:
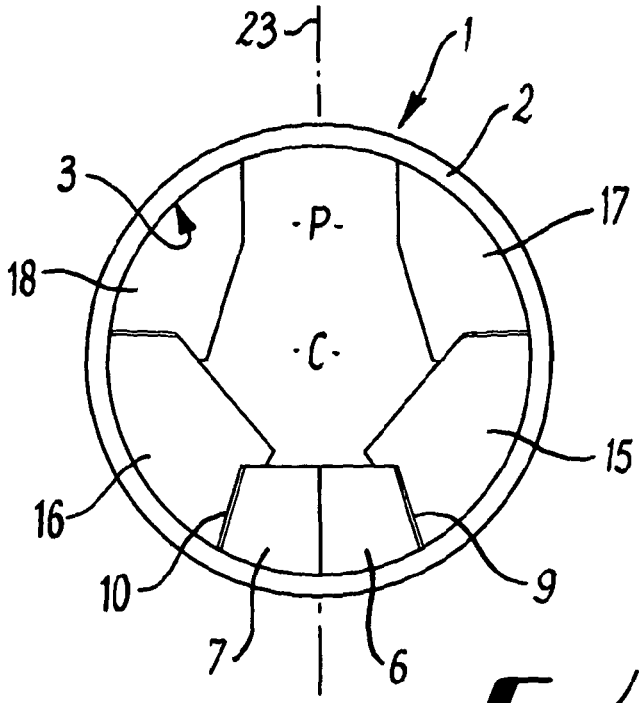
FIG. 8 shows a rear plan view of the second embodiment as viewed in the direction opposite to A from FIG. 6.

Turning to FIGS. 5 to 6, these show a second embodiment of a static mixer assembly according to the first aspect of the invention. The details are exactly as set out for the first embodiment, but in this embodiment the length of the tube of the static mixer assembly, measured along the central axis 20, is ¼ of the diameter 2R of the inside of the tube. In other words the length Z is R/2.

In use, the static mixer assembly of the invention, as shown in the first or second embodiment set out above, is positioned within a pipe so that fluid passes through the static mixture assembly in direction A, passing from upstream face 4 through downstream face 5 of the static mixer assembly. An ingredient to be mixed in to the fluid may be injected into the fluid at a location upstream of the static mixer assembly so that homogeneous mixing of the ingredient with the fluid is achieved downstream of the static mixer assembly.

It has been found particularly effective to introduce an ingredient to be mixed into the fluid using an ingredient insertion position upstream of the peripheral region P of the static mixer assembly. As has been explained in the description, the static mixer assembly may include an ingredient insertion port (not shown in the Figures) positioned to inject an ingredient in to the fluid. In such an embodiment of the invention, the injection takes place within the static mixer assembly rather than upstream of it.

A particularly advantageous design feature of the static mixer assemblies of the invention is that they may be easily formed. It can be seen for the embodiments shown that the fins 6, 7, 15, 16, 17, 18 may be simply machined from a plate of material, such as sheet metal, and inserted in to the tube 2, for instance, by cutting slots in wall 3 of the tube 2 and slotting the fins in to place in the slots then fixing them, for instance by welding.

The design of the static mixer assembly 6 of the invention also lends itself to providing a range of static mixer assemblies providing a range of static assemblies giving differing degrees of mixing depending upon the pressure drop which can tolerated across the static mixer assembly. For instance, referring to the first and second embodiments, the second embodiment as shown in FIGS. 5 to 8 will results in a considerably higher pressure drop than the first embodiment shown in FIGS. 1 to 4, but will also produce a higher degree of mixing at a shorter distance downstream of the mixer than the distance required to give the same degree of mixing downstream of the mixer of the first embodiment.

It can be seen from the Figures that the upstream edges of each fin are aligned substantially normal to the inner wall 3 of the tube 2. Similarly, the downstream edges of the fins are also positioned to be substantially normal to the inner wall 3 of the tube 2, say within +/−30° of the normal to the wall at the downstream location of the trailing edge.

It will be appreciated that the above embodiments are described by way of example only, and that various alternatives will be apparent to the skilled person as falling within the scope of the appended claims. For instance, the invention has been mainly set out with reference to a cylindrical tube but the invention is also applicable to a tube of any suitable cross section, such as square, rectangular or ellipsoidal. The invention may also be used with an open tube such as a channel adapted for liquid flow (for instance a channel of semicircular or U-shaped cross section). In such an embodiment of the invention, the upstream location of the first fins will be at the bottom of the channel and there will be no inner wall opposite the prow.

Experimental Results

The Experimental data set out below present the results of an investigation into the mixing characteristics and head-loss of three embodiments of the static mixer assembly of the invention, referred to hereinafter as E1, E2 and E3.

E1 is as shown in FIGS. 1 to 4 with a length the same as the diameter of the mixer assembly, and with the angular difference between the upstream and downstream location for each fin being about 30°.

E3 is as shown in FIGS. 5 to 8 with a length of 0.25 times diameter of the mixer assembly, and with the angular difference between the upstream and downstream location for each fin being about 70°.

E2 is not shown in the Figures, but is intermediate in shape between E1 and E2, with a length of 0.5 times diameter of the mixer assembly, and with the angular difference between the upstream and downstream location for each fin being about 50°.

Figure 10:
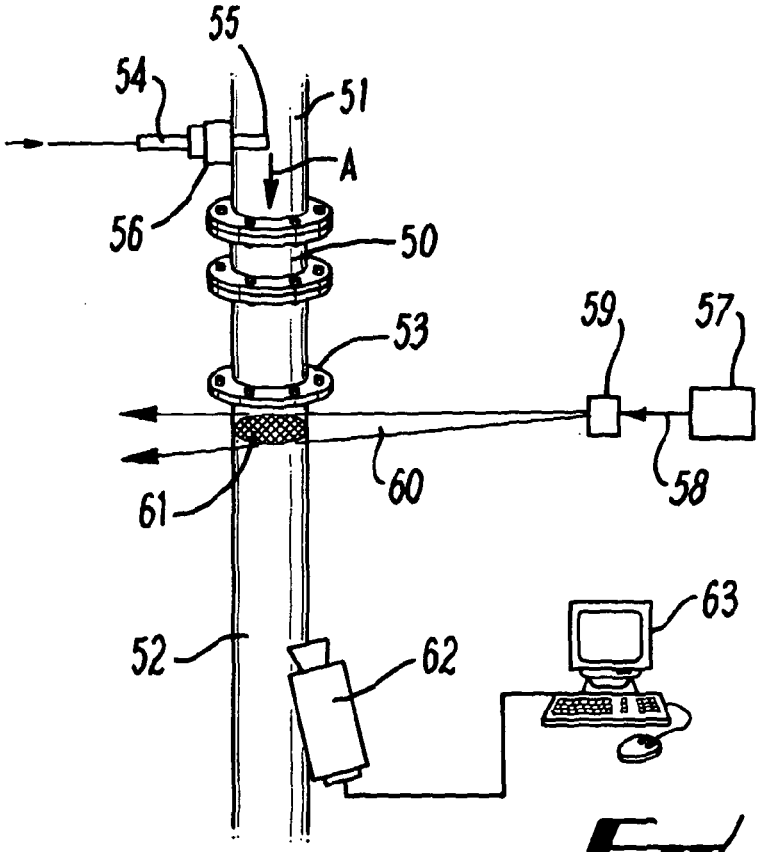
FIG. 10 shows a schematic perspective view of apparatus used to assess the mixing efficiency of static mixer assemblies of the invention by Laser Induced Fluorescence.

FIG. 10 shows schematically the experimental arrangement used for measurement of mixing efficiency. The technique used for measurement is Laser Induced Fluorescence (LIF).

The following nomenclature will be used below:

$C_{avg}$ average measured concentration of additive (ppb—parts per $10^9$ by weight)

$c_i$ concentration at ith probe position (ppb—parts per $10^9$ by weight)

ith pixel location

CoV coefficient of variation (dimensionless)

D main pipe or channel (m)

$D_H$ hydraulic diameter (m)

$F_D$ Darcy friction factor (dimensionless)

g acceleration due to gravity ($ms^{-2}$)

ΔH head-loss (m)

K system loss coefficient (dimensionless)

$L_m$ length of static mixer between the flange faces (m)

n number of pixel locations

Δp pressure drop ($N \cdot m^{-2}$)

q additive flow rate ($ml \cdot s^{-1}$)

Q bulk flow-rate ($Is^{-1}$)

U velocity of bulk flow ($m \cdot s^{-1}$)

ρ density ($kgm^{-3}$)

μ dynamic viscosity (Pa·s)

The following dimensionless groups are also discussed below:

$K$, System loss coefficient $K = \frac{\Delta H_{mixer}}{U^2/2g}$ $Re$, Reynolds number $Re = \frac{\rho U D}{\mu}$ $F_D$, Darcy friction factor $F_D = \frac{\Delta p D_H 2}{L_m U^2 \rho}$ FIG. 10 shows the experimental arrangement used. Inlet pipe 51 of internal diameter 10 cm is connected to the static mixer assemble 50 to be tested, also of internal diameter 10 cm, and a section of 10 cm internal diameter transparent Perspex™ pipe 52 is connected to the downstream face of the static mixer.

A laser 57 of a suitable wavelength to induce fluorescence of a Rhodamine™ WT dye is passed through an optical arrangement 59 configured to form a sheet of laser light normal to the central axis of the pipe at a location 1 m downstream of the trailing edge of the static mixer 50 to be tested.

Additive solution (containing fluorescent dye Rhodamine™ WT in aqueous solution/dispersion) is injected into the bulk flow (moving in direction A with a bulk flow rate Q) at an addition rate q, whereby the average concentration of additive dye in the bulk flow is $C_{avg}$.

The insertion tube 54 with insertion port 55 at its distal end is mounted into the pipe 51 through a sealed adjustment means 56 whereby the insertion port 51 may have its position adjusted relative to the central axis of the pipe. In the Figure, an arrangement with a central injection port is shown, but by withdrawing the insertion tube 54 through adjustment means 56, the injection port may be positioned to be flush with the internal wall of the pipe 51.

A Perspex™ viewing box (not shown for the sake of clarity) surrounds the section of transparent pipe 52 where the sheet of laser light 60 is present. The enclosure between the viewing box and the pipe 52 is filled with distilled water to avoid optical distortions due to the curved surface of the pipe as observed from the camera. One side of the viewing box is arranged such that the surface is perpendicular to the optical path from the section of pipe 52 illuminated by the sheet of laser light 60 to the camera 62 whereby refractive effects are reduced. The signal from the camera 62, in the form of image data, is transferred to the computer 63 for signal processing.

LIF (laser induced fluorescence) is a non-intrusive technique which enables the concentration distribution (and hence mixture quality) across the entire pipe cross-section at the laser sheet to be measured very accurately. The fluorescent dye (in this case Rhodamine™) is dosed into the apparatus and the resultant mixture passes through the sheet of laser light 60 positioned 1 m downstream of the mixer. As the dye passes through the laser sheet 60 it fluoresces and the resultant images are captured using a CCD camera 62. For each CoV measurement, a total of 150 images are captured over a 7.5 second period, where each image consists of 200,000 pixels. Each image was analysed and the fluorescence intensity (which is proportional to tracer concentration) measured for each pixel. This result in a highly accurate series of measurements from which CoV may be derived and a digital record of the mixture quality at a specified distance downstream of the mixer.

The experiments were set out to measure mixture quality (Coefficient of Variation—CoV) and head loss at 1 m downstream of the trailing edge of the three embodiments E1, E2 and E3, over a range of flow rates and ingredient dosage ratios. The variable positioning of the insertion port 55 also allowed the effect of repositioning this to be assessed. The insertion port was positioned 10 cm upstream of the leading edge of the mixer assembly in each case. Water was used as the bulk fluid.

Flow velocities for the water in the main flow for each set of experiments detailed below were from approximately 0.1 to 1 m/s (Re from 13,000 to 116,000). Three values of Q/q were used, 100, 1000 and 10000, where Q is the bulk flow rate in liters/second and q is the additive flow rate in ml/second. The additive stream had the same viscosity and density as the water bulk stream. Dye was injected into the mixer using a gear pump. Flow rates were measured using a calibrated digital flow meter for the higher flow rates and a set of rotameters for the lower flow rates.

The concentrations of the dye tracer used were 30,00, 3,000 and 300 ppm, for Q/q at 10000, 1000 and 100 respectively, in order to achieve a concentration of 3 ppb of Rhodamine WT in the mixed, bulk flow (note that Q is in liters/sec and q in ml/sec). Calibration images were obtained for dye concentrations of 2, 3 and 4 ppb. Using these calibration images with the fluorescence intensity images, the actual dye concentration was obtainable.

$$CoV_{Tavg} = \left[\frac{\sum_{i=1}^{n}(c_i - c_{avg})^2}{n}\right]^{0.5} \frac{1}{c_{avg}}$$

Time average $CoV_{Tavg}$, was calculated for each of the 150 images. The concentrations were time averaged for each pixel, as set out in the preceding equation, where, $c_i$=time averaged pixel value (ppb)

$c_{avg}$=$c_i$ averaged for all pixels (ppb)

n=total number of pixel locations.

Time averaged CoV is used as an industry standard for comparing mixer performance. Generally, a value of 0.05 for CoV is considered as good mixing.

The Experimental results, using the apparatus and experiments as set out above, are tabulated below in Table 1 for the three static mixer assemblies E1, E2 and E3 according to the invention.

TABLE 1

| Q/q | E3 (wall) | E2 (wall) | E2 (centre) | E1 (wall) |
|---|---|---|---|---|
| 100 | 0.027 | 0.037 | 0.051 | 0.017 |
| 1000 | 0.033 | 0.021 | 0.016 | 0.034 |
| 10000 | 0.047 | 0.032 | 0.038 | 0.044 |

The numbers in the table represent the averages over flow rates Q from 1 to 9 $l \cdot s^{-1}$ ($R_e$ from 13000 to 116000).

Hence, it can be seen that the apparatus of the invention gives good mixing results, as assessed by coefficient of variation (CoV), over wide ranges of mixer configurations, insertion point, bulk flow rates and ratios of additive to bulk flow.

Head-loss was measured using a differential water manometer connected to the apparatus as described above. The manometer was connected to pressure tappings, 1.3 m upstream and 1.8 m downstream of the mixer. Head-loss was measured as the vertical difference in water level between the two arms of the manometer. To calculate the head loss due to the mixer, the head loss in the 3.1 m length of the straight pipe was measured and subtracted from the total head loss measured by the manometer.

Head-loss was measured across the three mixers of the invention. ΔH(Total) includes pressure drop due to the mixer and the 3.1 m length of the straight pipe ΔH(Pipe) between the pressure tappings. ΔH(Pipe) is approximately 10 to 35% of the total head-loss and makes a significant contribution to the measured head-loss. ΔH(Mixer) was calculated as ΔH(Total)−ΔH(Pipe). The system loss coefficients were almost constant at Re>25,000.

Mixer system loss coefficients and Darcy Friction Factors were calculated from the head losses for the three mixers (using the density of water) for the range of $R_e$ studied of 13,000 to 116,000. The average results, across the range of $R_e$ studied, are shown in Table 2.

TABLE 2

| Mixer | $F_D$ (Darcy Number) | K (System Loss coefficient) |
|---|---|---|
| E3 | 23.0 | 5.7 |
| E2 | 6.1 | 3.0 |
| E1 | 1.6 | 1.7 |

These values varied little with $R_e$, less than +/−5% from the average. Clearly, the longer version of the mixer (E1) gives the lowest values for these numbers.

The described and illustrated embodiments are to be considered as illustrative and not restrictive in character, it being understood that only the preferred embodiments have been shown and described and that all changes and modifications that come within the scope of the inventions as defined in the claims are desired to be protected. It should be understood that while the use of words such as "preferable", "preferably", "preferred" or "more preferred" in the description suggest that a feature so described may be desirable, it may nevertheless not be necessary and embodiments lacking such a feature may be contemplated as within the scope of the invention as defined in the appended claims. In relation to the claims, it is intended that when words such as "a," "an," "at least one," or "at least one portion" are used to preface a feature there is no intention to limit the claim to only one such feature unless specifically stated to the contrary in the claim. When the language "at least a portion" and/or "a portion" is used the item can include a portion and/or the entire item unless specifically stated to the contrary.

The invention claimed is:

1. A fluid processing apparatus comprising a pipe arranged for flow of a fluid therethrough and a static mixer assembly operably disposed therein, the static mixer assembly including one or more tubes, each tube having a central axis with first, second and third pairs of fins extending inward from an inner wall of the tube, symmetrically arranged about a plane of symmetry passing through the central axis, the first, central pair of fins being arranged to form a prow along the plane of symmetry and pointing upstream with respect to the intended direction of flow of fluid through the static mixer, with second and third pairs of fins flanking the first pair of fins and arranged such that the first, second and third pairs of fins mutually overlap whereby unhindered fluid flow downstream with respect to the intended direction of flow of fluid through the static mixer, parallel to the central axis of the tube is prevented by the first, second, and third pairs of fins over a hindered peripheral, region of the tube, while allowing unobstructed flow in an unobstructed flow region of the tube, the unobstructed flow region including a central region of the tube around the central axis and extending to a peripheral region of the tube opposite the prow; the fluid processing apparatus further including an ingredient insertion port configured to inject an ingredient into the fluid within the pipe such that the injected ingredient flows through the unobstructed flow region of the tube.

2. A fluid processing apparatus according to claim 1, wherein the tube is a substantially cylindrical tube and the inner wall of the tube is a cylindrical wall which extends between upstream and downstream faces, each face substantially normal to a central axis of the tube and the plane of symmetry, the plane of symmetry passing through the central axis and along a diameter of the tube and defining first and second long axes, each parallel to the central axis and located where the plane of symmetry meets the inner wall of the tube, with any location within or on the inner cylindrical wall definable by cylindrical coordinates r,t,z, where t is the angle subtended at the central axis between the first long axis and the location, in a measurement plane, passing through the location and normal to the central axis, wherein r is the distance from the central axis to the location, measured in the measurement plane and wherein z is the distance, measured along the central axis, between the upstream plane and the measurement plane at a point where the central axis intersects the measurement plane, wherein r=R at the inner cylindrical wall, z=Z at the downstream plane and T=0° and r=R at the first long axis and T=180° and r=R at the second long axis, wherein each fin of the first, second and third pairs of fins extends inwards from an attachment edge at the inner wall of the tube and wherein each member of each pair of fins is positioned substantially symmetrically with respect to the other member of its respective pair on opposed sides of the plane of symmetry, each fin having a leading edge extending inwards from the inner wall at an upstream location, a trailing edge extending inwards from the inner wall at a downstream location, the attachment edge having a length connecting its respective fin to the inner wall between upstream and downstream locations and a deflection edge opposed to the attachment edge, wherein the upstream location of both first fins is at the upstream face, at r,t,z=R,0, Zu1 with the leading edges of the first fins joined to form a prow extending inward from the upstream location of the first fins and wherein the downstream locations of the first fins are positioned on opposite sides of the plane of symmetry at r,T,z=R, Td1,Zd1 and R,−Td1,Zd1, wherein the upstream locations of the second fins are at the upstream face, on opposite sides of the plane of symmetry, at r,t,z=R,Tu2, Zu2 and R,−Tu1, Zu2 with the downstream locations of the second fins at r,t,z=R,Td2,Zd2 and R,−Td2,Zd2, wherein the upstream locations of the third fins are at the upstream face, on opposite sides of the plane of symmetry, at r,t,z=R,Tu3,Zu3 and R,−Tu3,Zu3 with the downstream locations of the third fins at r,t,z=R,Td3,Zd3 and R,−Td3,Zd3, wherein 0≤Zu1≤Zu2≤Zu3, and Zd1>Zu1, Zd2>Zu2, Zd3>Zu3 wherein Zd1, Zd2 and Zd3≤Z, wherein Tu2<Td2, Tu3<Td3, and wherein Tu2<Td1, Tu3<Td2.

3. A fluid processing apparatus according to claim 2, wherein the length of the attachment edge for each fin, measured along a straight line between the upstream and downstream locations for the respective fin, is from 0.2R to 3R.

4. A fluid processing apparatus according to claim 2, wherein the value of r for any point along each deflection edge of each fin is 0.4 R or more, whereby a central region of the pipe extending at least 0.4R outwards from the central axis provides an unhindered fluid flow path.

5. A fluid processing apparatus according to claim 4, wherein the pairs of fins are configured to provide a perimetral region of the pipe extending at least 0.2R inwards from the inner cylindrical wall axis between t=+90° and t=−90° over which an undeviated fluid flow path parallel to the central axis is prevented.

6. A fluid processing apparatus according to claim 5, wherein the pairs of fins are configured to provide a perimetral region of the pipe extending at least 0.2R inwards from the inner cylindrical wall axis between t=+160° and t=−160° over which an undeviated fluid flow path parallel to the central axis is prevented.

7. A fluid processing apparatus according to claim 2, wherein the pairs of fins are configured to provide an unhindered flow path over at least a region defined by 170°≤t≤−170° and r≤R.

8. A fluid processing apparatus according to claim 2, wherein Zu1=Zu2=Zu3.

9. A fluid processing apparatus according to claim 8, wherein Zu1=Zu2=Zu3=0 whereby the upstream location of the leading edges is at the upstream face of the static mixer assembly.

10. A fluid processing apparatus according to claim 2, wherein Zd3>Zd2>Zd1.

11. A fluid processing apparatus according to claim 2, wherein Zd3 is from 0.3R to 1.5R.

12. A fluid processing apparatus according to claim 11, wherein Zu1=0 and Zd3=Z.

13. A fluid processing apparatus according to claim 2, wherein Tu3 is 120° or less.

14. A fluid processing apparatus according to claim 2, wherein Tu3 is 90° or less.

15. A fluid processing apparatus according to claim 2, wherein the angular difference between the upstream and downstream location for each fin is from 25° to 70°.

16. A fluid processing apparatus according to claim 2, wherein each fin is a substantially flat plate.

17. A fluid processing apparatus according to claim 2, wherein each fin is arranged substantially normal to the inner cylindrical wall and extends inwards towards the central axis.

18. A fluid processing apparatus according to claim 16, wherein each fin is located in a respective straight slot in the inner cylindrical wall configured to accept a fin.

19. A fluid processing apparatus according to claim 2, wherein the ingredient insertion port positioned at a position Rp,Tp,Zp wherein 0.8R≤Rp≤R, 170°≤Tp≤−170° and 0≤Zp≤Z.

20. A fluid processing apparatus according to claim 2 wherein each fin has a thickness of R/30 or less.

21. A fluid processing apparatus according to claim 1, further comprising an ingredient insertion port positioned to inject an ingredient into the fluid within the pipe at a location upstream or downstream of the static mixer assembly whereby homogeneous mixing of said ingredient with said fluid is achieved, during use of the fluid processing apparatus, downstream of the static mixer assembly.

22. A fluid processing apparatus according to claim 21 wherein the tube is a substantially cylindrical tube and the inner wall of the tube is a cylindrical wall which extends between upstream and downstream faces, each face substantially normal to a central axis of the tube and a plane of symmetry, the plane of symmetry passing through the central axis and along a diameter of the tube and defining first and second long axes, each parallel to the central axis and located where the plane of symmetry meets the inner wall of the tube, with any location within or on the inner cylindrical wall definable by cylindrical coordinates r,t,z, where t is the angle subtended at the central axis between the first long axis and the location, in a measurement plane, passing through the location and normal to the central axis, wherein r is the distance from the central axis to the location, measured in the measurement plane and wherein z is the distance, measured along the central axis, between the upstream plane and the measurement plane at a point where the central axis intersects the measurement plane, wherein r=R at the inner cylindrical wall, z=Z at the downstream plane and T=0° and r=R at the first long axis and T=180° and r=R at the second long axis, and wherein the ingredient insertion port is located to deliver the ingredient to enter into the static mixer assembly at a position Rp,Tp,Zp wherein 0.8R≤Rp≤R, 170°≤Tp≤−170° and Zp=0.

* * * * *